US006811217B2

(12) United States Patent
Kane et al.

(10) Patent No.: US 6,811,217 B2
(45) Date of Patent: Nov. 2, 2004

(54) ROCKER DEVICE

(75) Inventors: Michael Kane, Conesus, NY (US); Robert David Piwko, Jr., Hamburg, NY (US); John F. Rhein, Hamburg, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/403,512

(22) Filed: Apr. 1, 2003

(65) Prior Publication Data

US 2004/0031097 A1 Feb. 19, 2004

Related U.S. Application Data

(63) Continuation-in-part of application No. 29/165,620, filed on Aug. 15, 2002, now Pat. No. Des. 480,884.

(51) Int. Cl.[7] ..... A47D 13/10

(52) U.S. Cl. ..... 297/270.2; 297/271.6; 297/270.5

(58) Field of Search ..... 297/270.1, 270.2, 297/270.3, 271.6, DIG. 11, 258.1, 270.5

(56) References Cited

U.S. PATENT DOCUMENTS

| | | | | | |
|---|---|---|---|---|---|
| 597,581 | A | * | 1/1898 | Kluenter | 297/270.3 |
| 804,958 | A | * | 11/1905 | Kohn | 297/271.6 |
| D100,181 | S | | 6/1936 | Terker | |
| D101,632 | S | | 10/1936 | Hoffmann | |
| D102,046 | S | | 11/1936 | Wexelblatt | |
| D151,675 | S | | 11/1948 | Bird | |
| 2,560,963 | A | * | 7/1951 | Kornegay | 297/270.3 |
| D180,031 | S | | 4/1957 | Pearlstine | |
| 2,854,062 | A | * | 9/1958 | Hetchler | 297/270.3 |
| 3,099,477 | A | | 7/1963 | O'Herron | |
| 3,334,944 | A | | 8/1967 | Gould et al. | |
| 3,492,047 | A | | 1/1970 | Dudouyt | |
| 3,528,701 | A | | 9/1970 | Laughlin | |
| 4,141,095 | A | | 2/1979 | Adachi | |
| 4,218,093 | A | * | 8/1980 | Gertz | 297/423.43 |
| 4,371,206 | A | | 2/1983 | Johnson, Jr. | |
| 4,688,850 | A | | 8/1987 | Brownlie et al. | |
| D311,822 | S | | 11/1990 | Meeker | |
| 5,052,749 | A | | 10/1991 | Groenendijk | |
| D326,958 | S | | 6/1992 | Royle et al. | |
| 5,178,438 | A | | 1/1993 | Beger | |
| 5,322,343 | A | | 6/1994 | Parker et al. | |
| 5,507,564 | A | | 4/1996 | Huang | |
| 5,617,594 | A | * | 4/1997 | Chien | 5/102 |
| D383,319 | S | | 9/1997 | Montes de Oca | |
| D388,621 | S | | 1/1998 | Reese | |
| 5,860,698 | A | | 1/1999 | Asenstorfer et al. | |
| 6,341,816 | B1 | | 1/2002 | Chen et al. | |
| 6,431,646 | B1 | * | 8/2002 | Longoria | 297/217.3 |
| D480,884 | S | | 10/2003 | Kane et al. | |
| D491,736 | S | | 6/2004 | Kane et al. | |

* cited by examiner

*Primary Examiner*—Peter R. Brown
(74) *Attorney, Agent, or Firm*—Cooley Godward LLP

(57) ABSTRACT

A support frame for a infant or child support device is disclosed. The frame includes oval shaped side members that provide a wide, safe base and a smooth rocking action to the rocker. The kickstand may be used to convert the support frame from a rocking configuration into a stable, non-rocking configuration. The support frame may also include a seat that can be removed from the support frame.

12 Claims, 5 Drawing Sheets

ROCKER DEVICE

CROSS REFERENCE TO RELATED APPLICATION

This application is a continuation-in-part of U.S. Design patent application Ser. No. 29/165,620, entitled "Rocker Device," filed Aug. 15, 2002, U.S. Pat. No. D,480,884 Attorney Docket No. FSHR-050/00US, the disclosure of which is incorporated herein by reference in its entirety.

BACKGROUND OF THE INVENTION

This invention relates generally to an infant support device, and more particularly, to a frame for an infant rocker.

Conventional infant supports have various types of frames. Some infant supports are configured to be stationary or static while other infant supports are configured for movement with respect to a support surface. For example, some infant supports are configured to rock back and forth and are referred to generally as rockers.

The configuration of the frame of an infant support can determine the type of movement achieved by an infant support. For example, some infant supports have planar bases and resilient frames that allow the upper portion of the frame to move with respect to the ground. Other infant supports have rigid frames that are fixed relative to the ground. Still other infant supports, such as the infant rockers, have curved lower surfaces or bases that facilitate rocking of the infant support.

Thus, there is a need for a frame that facilitates both rocking and stationary use of an infant support. There is also a need for an infant support frame with an efficient design. A need also exists for an easily adjustable infant support that is reconfigurable between a rocking configuration and a static configuration.

SUMMARY OF THE INVENTION

An infant support includes a support frame. In one embodiment, the support frame includes side members and a cross member extending between the side members. In one embodiment, the cross member is a kick stand that can be selectively disposed in multiple positions. In one position, the kick stand is retracted and does not prevent movement of the infant support. In another position, the kick stand is extended and prevents movement of the infant support with respect to a support surface.

In one embodiment, the support frame includes a back support bar. The back support bar is coupled to the side members. The back support bar can be selectively disposed in multiple positions with respect to the support frame. In one embodiment, softgoods in the form of a seat can be disposed on the frame.

In another embodiment, the infant support is an infant rocker that includes a frame and a softgoods seat that can be used to support the weight of an infant. The infant support can include an output generator that outputs soothing or stimulating effects such as vibration and/or audible outputs. The infant support can include a toy bar coupleable to the frame. The toy bar can include multiple objects suspended therefrom.

DETAILED DESCRIPTION

An infant support includes a support frame. In one embodiment, the support frame includes side members and a cross member extending between the side members. In one embodiment, the cross member is a kick stand that can be selectively disposed in multiple positions. In one position, the kick stand is retracted and does not prevent movement of the infant support. In another position, the kick stand is extended and is configured to prevent movement of the infant support with respect to the support surface on which the frame is disposed.

In an alternative embodiment, the support frame includes a back support bar. The back support bar is coupled to the side members. The back support bar can be selectively disposed in multiple positions with respect to the remainder of the support frame. In one embodiment, a softgoods seat can be disposed on the frame to support the weight of an infant.

In another embodiment, the infant support is an infant rocker that includes a frame and a softgoods seat that can be used to support the weight of an infant. The infant support can include an output generator that outputs soothing or stimulating effects such as vibration and/or audible outputs. In one embodiment, the infant support can include a toy bar that is coupleable to the frame. The toy bar can include multiple objects suspended therefrom.

Figure 1:
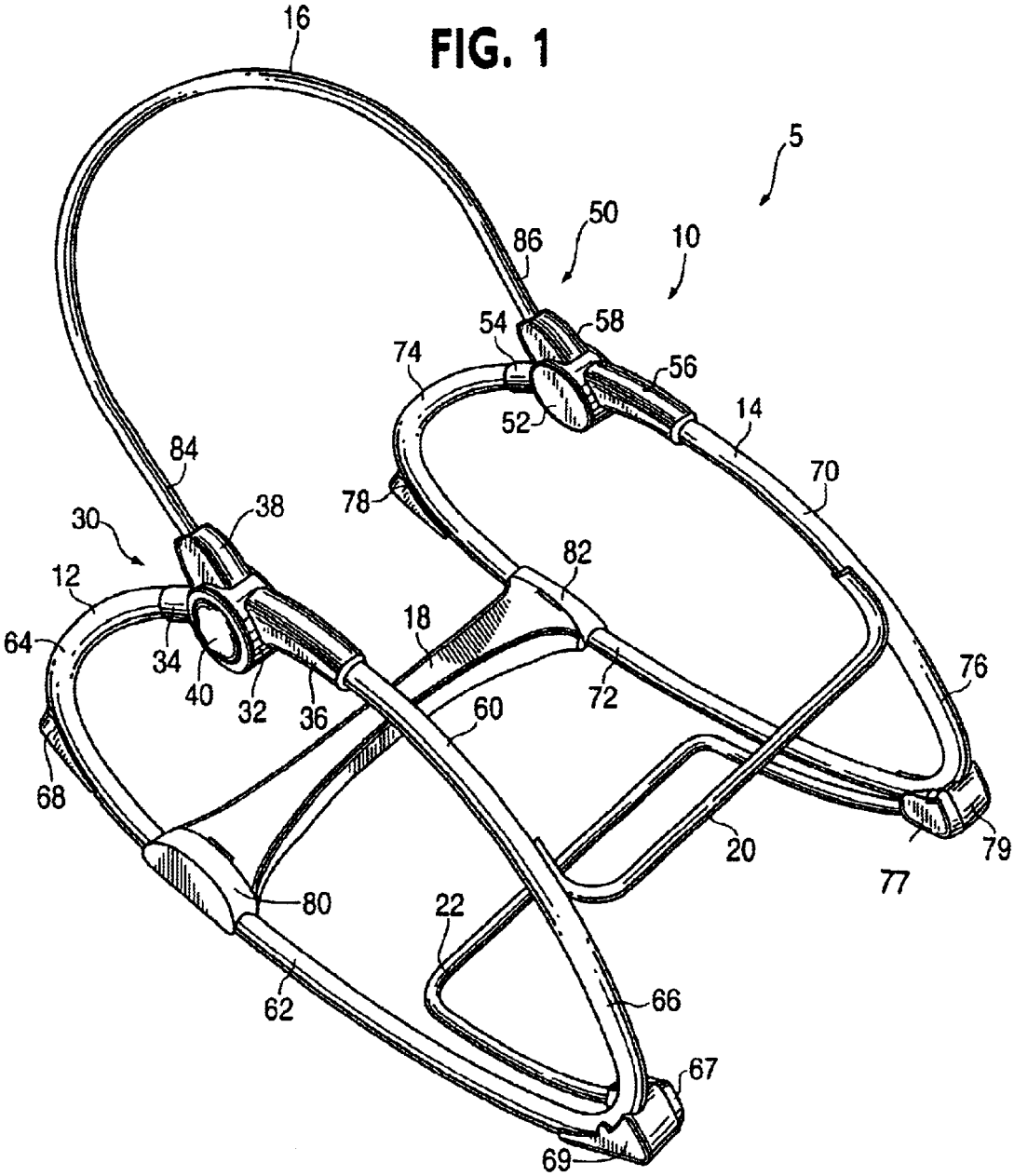
FIG. 1 is a perspective view of a frame according to an embodiment of the invention.

A support device according to an exemplary embodiment of the invention is illustrated in FIG. 1. In this embodiment, the support device 5 includes a frame 10. Frame 10 includes side members 12 and 14 and several support or structural members 16, 18, 20 and 22. Support or structural members 16, 18, 20 and 22 can be referred to alternatively as cross members because each is coupled to both side members 12 and 14. In alternative embodiments, the frame can have any number of support or structural members.

Support member 16 can be referred to as a back portion or back support bar 16. Back support bar 16 can be substantially U-shaped and is configured to support softgoods material (not illustrated in FIG. 1) thereon. The softgoods material can be any conventional fabric material on which an infant can be supported. Support member 20 is configured to support a front end (i.e., the end adjacent a foot support portion) of a softgoods seat disposed on the frame 10.

Support member 18 is coupled to the lower portions of the side members 12 and 14. Support member 18 provides additional stability to the frame 10 by maintaining a constant distance between the two side members. Support member 18 can also provide a ground-engaging contact surface to modify the rocking motion of the frame.

Support member 22 is pivotally coupled to the frame 10 and is selectively movable between an extended position and a retracted position, as discussed in greater detail below.

The frame 10 includes connection assemblies 30, 50 that are configured to couple various components of the frame 10 together. Connection assembly 30 couples side member 12 and support member 16. Similarly, connection assembly 50 couples side member 14 and support member 16.

The connection assemblies 30, 50 include a moveable portion 38, 58 and a release mechanism 40 that allows the moveable portion 38, 58 to move with respect to the frame 10 when the button 40 is pushed. The back support bar 16 is attached to the moveable portion 38, 58 such that when the moveable portion 38, 58 is moved, the back support bar 16 moves with respect to the side members 12, 14 to vary the relative position of the back support bar 16 with respect to the side members 12, 14.

Each side member 12, 14 has a generally curved shape that includes multiple curved portions. Referring to FIG. 1, side member 12 includes an upper portion 60, a lower portion 62, a rear portion 64 and a front portion 66. The portions 60, 62, 64 and 66 form a continuous support frame. Similarly, side member 14 includes an upper portion 70, a lower portion 72, a rear portion 74 and a front portion 76. The portions 70, 72, 74 and 76 form a continuous support frame.

Figure 2:
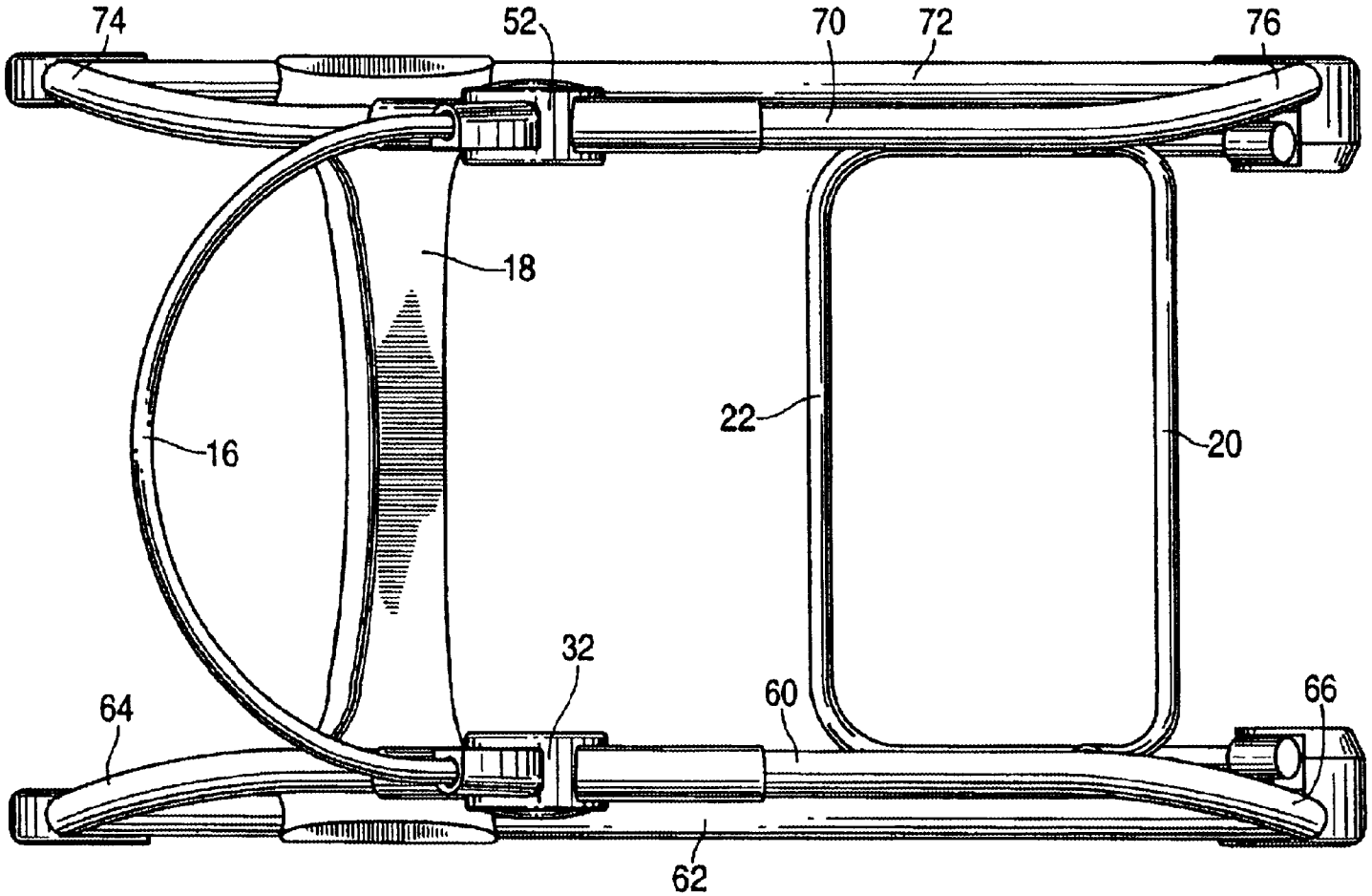
FIG. 2 is a top view of the frame illustrated in FIG. 1.
Figure 3:
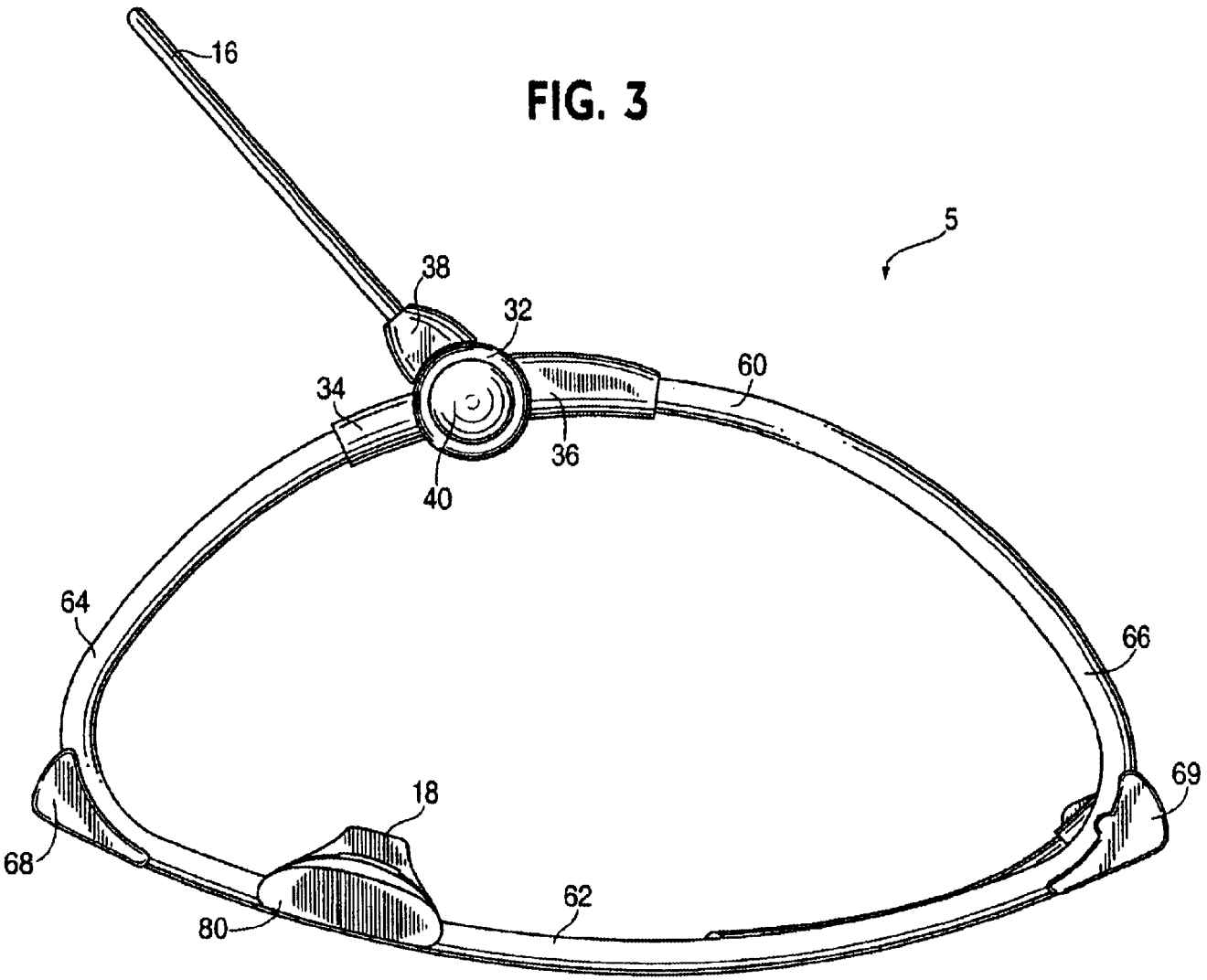
FIG. 3 is a side view of the frame illustrated FIG. 1.

In the illustrated embodiment, side members 12 and 14 are mirror images of one another. Accordingly, only side member 12 is discussed in detail where appropriate. Referring to FIGS. 2 and 3, the configuration of side member 12 is illustrated.

The lower portion 62 of the side member 12 includes a lower surface that contacts a support surface, such as a floor. The lower portion 62 has a slightly curved configuration and a large radius of curvature. The extent of the curvature of the lower portion 62 determines the particular rocking motion imparted to the frame.

The upper portion 60 can have a greater radius of curvature than the lower portion 62. However, in the embodiment illustrated in FIG. 3, the upper portion 60 has a smaller radius of curvature than the lower portion 62. As best illustrated in FIG. 2, the side members 12, 14 are angled inwardly, the distance between the upper portions 60, 70 being less than the distance between the lower portions 62, 72. The inward angle provides a wider footprint of the device 5, thereby increasing the overall stability of the frame 10.

In the illustrated embodiment, as best seen in FIG. 3, the side member 12 is approximately twice as long as it is tall. Moreover, the upper curved portion extends approximately twice the distance above the axis defined between the apices of the front and rear curved portions as the lower curved portion. This configuration provides an efficient design that allows a long, smooth rocking motion without sacrificing stability.

In the illustrated embodiment, the side members 12, 14 also include rear feet 68, 78 and front feet 69, 79. The feet 68, 69, 78, 79 are configured to prevent the frame 10 from traveling too far and tipping over when rocking. The combination of the shape and dimension of side members 12, 14 and the inclusion of feet 68, 69, 78, 79 provides a stable support frame. The lower cross member 18 is attached to the side members 12, 14 and is operative to provide rigidity to the frame as discussed above.

In the illustrated embodiment, the frame 10 also includes a front support member 20. The front support member 20 is attached between the side members 12, 14. The front support member 20 is configured provide stiffness for the frame 10 and support a seat that is attachable to the frame 10 as will be discussed in greater detail below.

In the illustrated embodiment, the frame 10 also includes support member 22. The support member 22 is pivotally coupled to the side members 12, 14 at pivot portions 67, 77 of the front feet 69, 79. The pivot portions 67, 77 of the front feet 69, 79 can pivot with respect to the front feet 69, 79. Thus, the support member 22 can be repositioned between an extended position in which it engages the ground to prevent the frame 10 from rocking, and a retracted or a folded position to allow the frame 10 to rock as discussed above. Detent assemblies (not illustrated) can be provided between the pivot portions 67, 77 and the front feet 69, 79 to maintain the support member 22 in the extended and retracted positions.

Each of the support members 16, 18, 20, 22 described above may be attached to the side members 12, 14 with any manner of conventional attachment means, including screws, bolts, rivets, friction fit, adhesive, welding, etc. Moreover, each of the support members 16, 18, 20, 22 can be formed from lightweight metal tubing of sufficient strength to support the weight of an infant.

Figure 4:
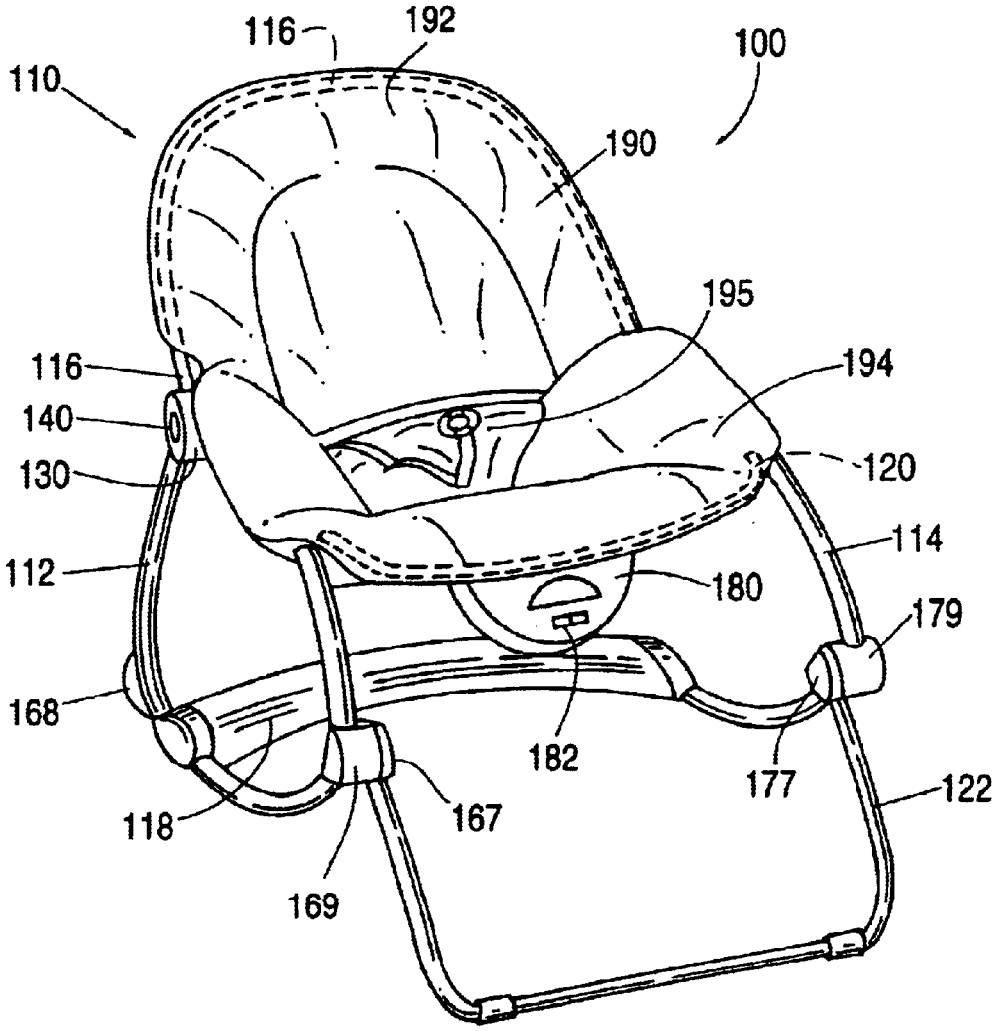
FIG. 4 is a front perspective view of a frame in a stable configuration according to an alternative embodiment of the invention.
Figure 5:
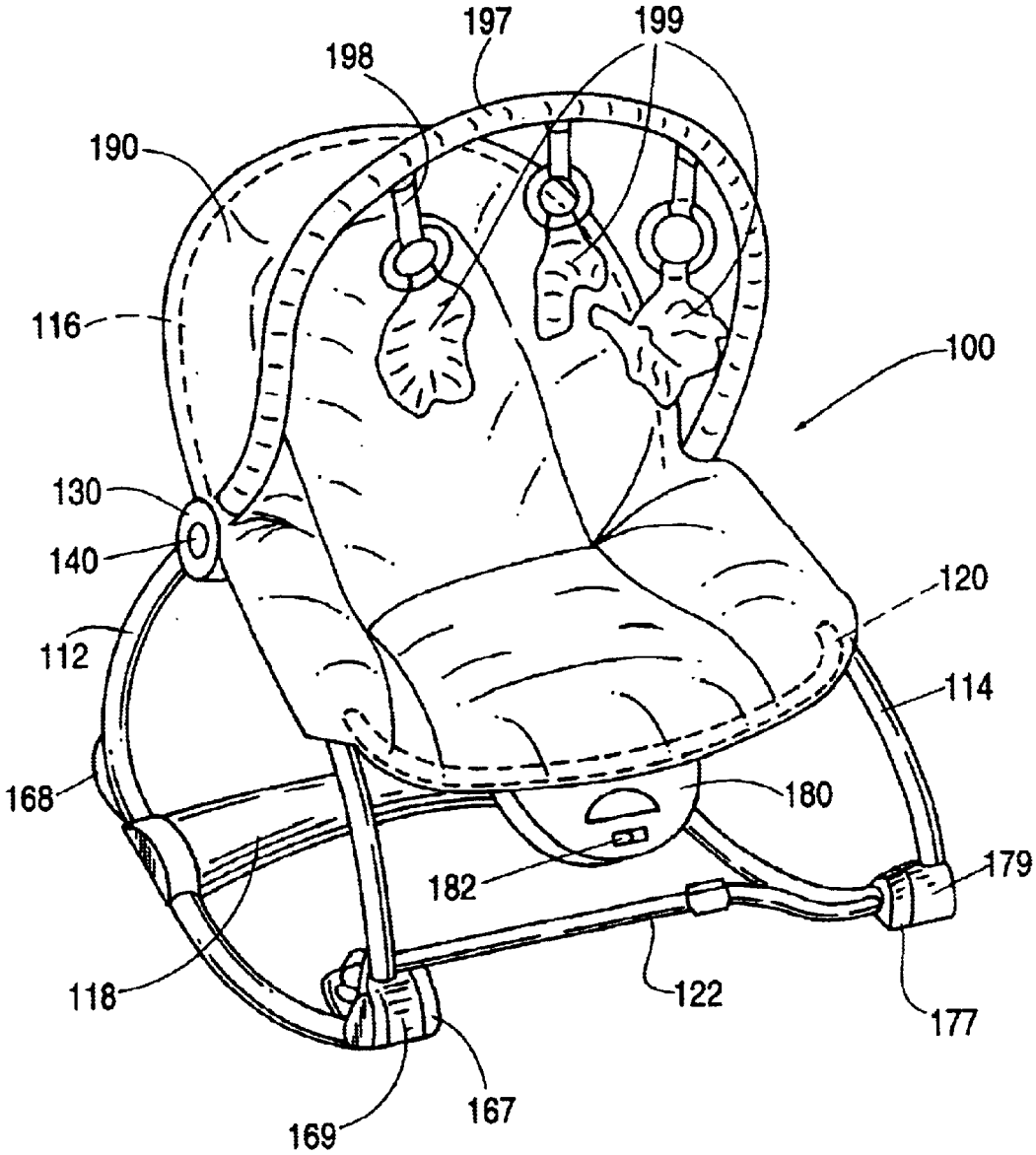
FIG. 5 is a front perspective view of a frame in a rocking configuration according to an alternative embodiment of the invention.

FIGS. 4 and 5 illustrate an alternative embodiment of the invention. The illustrated rocker 100 includes a support frame 110 similar to frame 10 discussed above and further includes a seat 190. The frame 110 includes side members 112, 114, and support members 116, 118, 120 and 122.

Connection members 130 (only one visible in FIGS. 4 and 5) include an actuator 140 to allow the relative position of the back support bar 116 to be modified with respect to the side members 112, 114. The ability to move the back support bar 116 relative to the side members 112, 114 allows the seat 190 to be positioned in multiple configurations (i.e., varying degrees of recline).

The seat 190 is substantially elliptical or oval in plan view and includes an upper seating surface 192 upon which an infant can be positioned and a lower foot portion 194 adjacent the upper seating surface 192. The foot portion 194 and the upper seating surface 192 may be integrally formed or may be removably coupled. The seat 190 can be manufactured from fabric or similar material. Alternatively, the seat 190 may be manufactured from other flexible materials such as vinyl, molded plastic or the like. The seat 190 may include a quilted surface to provide greater comfort for the infant positioned therein and may be manufactured using multiple layers of fabric between which batting material may be accommodated. The seat 190 may also include a rigid backing (not illustrated) to provide additional support. The rigid backing may be integral to the seat 190 or may be detachable from the seat 190. Alternatively, the rigid backing may also be removably or fixedly coupled to the frame 110.

The seat 190 is adapted to be supported on the support frame 110. To support the seat 190 on the frame 110, attachments are provided such that when an infant is positioned on the seat 190, the weight of the infant is carried by the support frame 110 so that the support frame 110 bears the load. The attachments may be in the form of pockets on a rear surface of the seat 190 that are adapted to engage the support frame 110. For example, a first pocket can slidably receive the back support bar 116, and a second pocket can slidably receive the front support member 120. Alternatively, hook and loop fasteners, snaps, buttons, clips, pins, etc. may be used to couple the seat 190 to the frame 110.

To maintain the infant securely in seat 190, a belt 195 may be coupled to the seat 190. The belt 195 can be provided with separable buckles for easy operation. Any infant restraint device known to those skilled in the art may be utilized with the seat 190 without departing from the scope of the invention. The belt 195 can be removed from the seat 190 such that the rocker can be used by older children as a rocking chair.

The rocker 100 can include a toy bar 197 suspended above the seat 190 (see FIG. 5). A fastener 198 is provided and configured to suspend an article 199 from the toy bar 197 within reach of an infant positioned on the upper seating surface 192. In an alternative embodiment, several fasteners 198 and several articles 199 can be provided.

Each article 199 may be an infant toy or a variety of infant toys and may be removably or permanently attached to the fastener 198 by a fastener such as a hook and loop type fastener or a ring coupled through a fabric loop. The toy bar 197 can be removably coupled to the connection assemblies 130 by conventional methods.

In the illustrated embodiment, the rocker 100 includes an output generator 180 coupled to front support member 120. The output generator includes at least one actuator switch 182. The output generator includes a battery compartment (not illustrated) and is configured to output vibrations and/or soothing sounds such as music or other soothing and/or stimulating sounds. Any combination of outputs may be provided.

The vibrations generated by the output generator are imparted to the frame 110 and the seat 190 to sooth the infant or child using the rocker 100. The sounds are emitted from a transducer such as a speaker contained in the output generator 180. The vibrations and sounds are selected from vibration patterns and sounds saved in memory local to the electronics box and may include a variety of different vibrations and sounds.

In use, the device 100 can be utilized in a stationary configuration as illustrated in FIG. 4. In such a configuration, the support member 122 is used as a kickstand to retain the position of the seat 190 relative to the support surface on which the device 100 is situated (i.e., to prevent rocking motion). Moreover, in the stationary configuration illustrated in FIG. 4, the rear feet (only rear foot 168 is illustrated) are biased toward the ground to provide greater stability.

To be utilized as a rocker, the support member 122 is retracted or nested with the lower portion of side members 112, 114 as illustrated in FIG. 5. The curvature of support member 122 can be substantially similar to that of the side members 112, 114 such that it does not interfere with the rocking motion. Detent assemblies can be provided between pivoting portions 167, 177 and feet 169, 179 to maintain the support member 122 in the expanded or retracted configurations.

While particular, illustrative embodiments of the invention have been described, numerous variations and modifications exist that would not depart from the scope of the invention. For example, although the support members 22, 122 are described as having a curved configuration, the support members 22, 122 can be any configuration such that each provides the required stability in the expanded configuration and does not interfere with the rocking motion when in the retracted configuration.

Although the support members 16, 18, 20, 22, 116, 118, 120, 122 are described as being formed from metal tubing, the support members may be formed from plastic or similar materials with sufficient strength to support the weight of an infant.

Although the support members 22, 122 are described as being pivotally coupled to the corresponding frame, the support members 22, 122 may be removably coupled to the frame such that each is coupled to the frame for use of the device in the static configuration and removed from the frame for use of the device in the rocker configuration.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. A rocker, comprising:

a left side member and a right side member, the left and right side members each having a generally oval shape with a top curved portion and a bottom curved portion, each of the bottom curved portions being configured to rock on a support surface, each bottom curved portion having a larger radius of curvature than each top curved portion; and a plurality of cross members, each of the plurality of cross members configured to couple the left side member and right side member, one cross member of the plurality of cross members being configured to support a top portion of a support seat, the one cross member of the plurality of cross members being configured to move relative to the left side member and right side member.

2. The rocker of claim 1, wherein one cross member of the plurality of cross members is a kickstand configured to be moved between a folded position in which the rocker can rock relative to the support surface and an extended position in which the rocker is maintained in a static configuration.

3. The rocker of claim 1, further comprising an output generator coupled to one of the plurality of cross members, the output generator being configured to emit at least one of vibration and sound.

4. The rocker of claim 1, further comprising:

the support seat being disposed between the left side member and the right side member, the support seat being supported by the side members and at least one of the plurality of cross members.

5. A rocker, comprising:

a right side member and a left side member, the right and left side members each having a generally oval shape with a front end portion and a rear end portion, the front end portion and rear end portion each having a substantially similar curved shape;

a plurality of feet attached to the bottom of the curved portion, the feet being configured to limit the extent of a rocking motion of the rocker;

a plurality of cross members, each of the plurality of cross members configured to couple the left side member and the right side member; and a support seat disposed between the left side member and the right side member, the support seat being supported by the side members and at least one of the plurality of cross members, one cross member of the plurality of cross members being configured to support a top portion of the support seat, the one cross member of the plurality of cross members being configured to move relative to the left side member and right side member.

6. The rocker of claim 5, wherein one of the plurality of cross members is a kickstand configured to be moved between a folded position in which the rocker can rock relative to a support surface and an extended position in which the one of the plurality of cross members engages the support surface and the rocker is maintained in a static configuration.

7. The rocker of claim 5, further comprising an output generator attached to one of the plurality of cross members, the output generator being configured to emit at least one of vibration and sound.

8. A rocker comprising:

a right side member and a left side member, each of the side members having a generally oval shape with a top curved portion and a bottom curved portion, the top curved portion and the bottom curved portion meeting at a front end curved portion and a rear end curved portion, the top curved portion extending a first distance above an axis defined between the apices of the front end curved portion and the rear curved portion, the bottom curved portion extending a second distance below the axis, the first distance being approximately twice the second distance, and the maximum distance between the front end curved portion and the rear end curved portion being approximately twice the maximum distance between the top curved portion and the bottom curved portion;

a plurality of cross members, each of the plurality of cross members configured to couple the left side member and the right side member; and a support seat disposed between the left side member and the right side member and being supported by the side members and at least one of the plurality of cross members.

9. The rocker of claim 8, wherein one of the plurality of cross members is a kickstand configured to be moved between a folded position in which the rocker can rock relative to a support surface and an extended position in which the one of the plurality of cross members engages the support surface and the rocker is maintained in a static configuration.

10. The rocker of claim 8, further comprising an output generator coupled to one of the plurality of cross members, the output generator being configured to emit at least one of vibration and sound.

11. The rocker of claim 8, wherein one of the plurality of cross members is configured to support a top portion of the support seat, the cross member being configured to move relative to the left side and right side members.

12. The rocker of claim 11, further comprising a toy bar configured to support toys above the support seat.

* * * * *